United States Patent [19]

Crowley et al.

[11] Patent Number: 4,662,297

[45] Date of Patent: May 5, 1987

[54] KNOCK-DOWN BOAT

[76] Inventors: Kevin J. Crowley, 13 Fair St., Newburyport, Mass. 01950; Michael A. Gaffin, 16 Webster La., Wayland, Mass. 01778

[21] Appl. No.: 701,099

[22] Filed: Feb. 13, 1985

[51] Int. Cl.[4] ..... B63B 7/04

[52] U.S. Cl. ..... 114/61; 114/354

[58] Field of Search ..... 114/355, 357, 354, 343, 114/61, 39, 264, 267, 266; 441/43, 73

[56] References Cited

U.S. PATENT DOCUMENTS

| | | | |
|---|---|---|---|
| 3,796,175 | 3/1974 | Ford | 114/61 |
| 3,883,909 | 5/1975 | Fisher | 114/61 |
| 4,295,236 | 10/1981 | Upchurch | 114/357 |
| 4,362,519 | 12/1982 | Gault | 114/357 |
| 4,528,925 | 7/1985 | Pyburn | 114/61 |

*Primary Examiner*—Joseph F. Peters, Jr.
*Assistant Examiner*—C. T. Bartz
*Attorney, Agent, or Firm*—Weingarten, Schurgin, Gagnebin & Hayes

[57] ABSTRACT

A boat capable of being assembled, disassembled and transported by one individual and without any tools or special equipment. The boat comprises a superstructure which is substantially of lightweight buoyant material such as foam board, and which includes a pair of ski-like hulls, a longitudinal member removably attached to each hull, and a pair of transverse members removably interconnecting the hulls in spaced relation. A cockpit area is provided between the hulls and transverse members. The superstructure is preferably composed of only three components employed in pairs; the hull members, the longitudinal members, and the transverse members. Each of these components are preferably die cut from the same material, and each component of the superstructure has joint elements integrally formed therewith for interconnecting the components. When used as a sailing craft, a mast is removably attachable to the superstructure and to which a sail assembly is rigged. A rudder is removably attached to the aft end of each hull and a daggerboard can be removably installed in each hull. The boat can also be used with paddles or with an outboard motor.

6 Claims, 10 Drawing Figures

KNOCK-DOWN BOAT

FIELD OF THE INVENTION

This invention relates to boats, and more particularly to small sailing or other boats of disassemblable construction.

BACKGROUND OF THE INVENTION

Constructions are known for providing a boat which can be assembled and disassembled for ease of transport. One well-known type is the inflatable boat, in which the hull is formed of one or more inflatable compartments. Another type is a foldable boat construction which employs a frame of relatively rigid elements which can be assembled and disassembled, and over which a fabric or other skin is affixed as the outer hull material. This latter type of boat is available, typically, as a canoe or canoe sailboat. Another known boat construction utilizes assembled sections which are fastened together to form the hull. Also known is the so-called board boat of which some are constructed of a single hull, somewhat like a surfboard, and which is of rigid plastic or foam construction.

SUMMARY OF THE INVENTION

In accordance with this invention, a knock-down boat is provided which is of extremely lighweight construction and which can be readily assembled and disassembled without tools by one individual and which, when disassembled, can be readily carried by one individual. The boat comprises a superstructure which is substantially of lightweight buoyant material such as foam board, and which includes a plurality of ski-like hulls, a longitudinal member removably attached to each hull, and a plurality of transverse members removably interconnecting the hulls in spaced relation and which also serve to support a cockpit area or surface. Each of the components of the superstructure are preferably die cut from the same material, and each component has integrally formed therewith the joint elements for interconnecting the components.

The boat may be used as a sailing craft, or with paddles or an outboard motor. For sailing, a mast is attached to the superstructure by a fitting provided thereon, and a sail and spar assembly is rigged to the mast by any convenient means. Each hull has a rudder pivotably attached to the aft end, and may have a daggerboard removably fitted therethrough. A mounting bracket can be attached to the superstructure for attachment of an outboard motor.

BRIEF DESCRIPTION OF THE DRAWINGS

The invention will be more fully understood from the following detailed description taken in conjunction with the accompanying drawings in which.

DETAILED DESCRIPTION OF THE INVENTION

Figure 1:
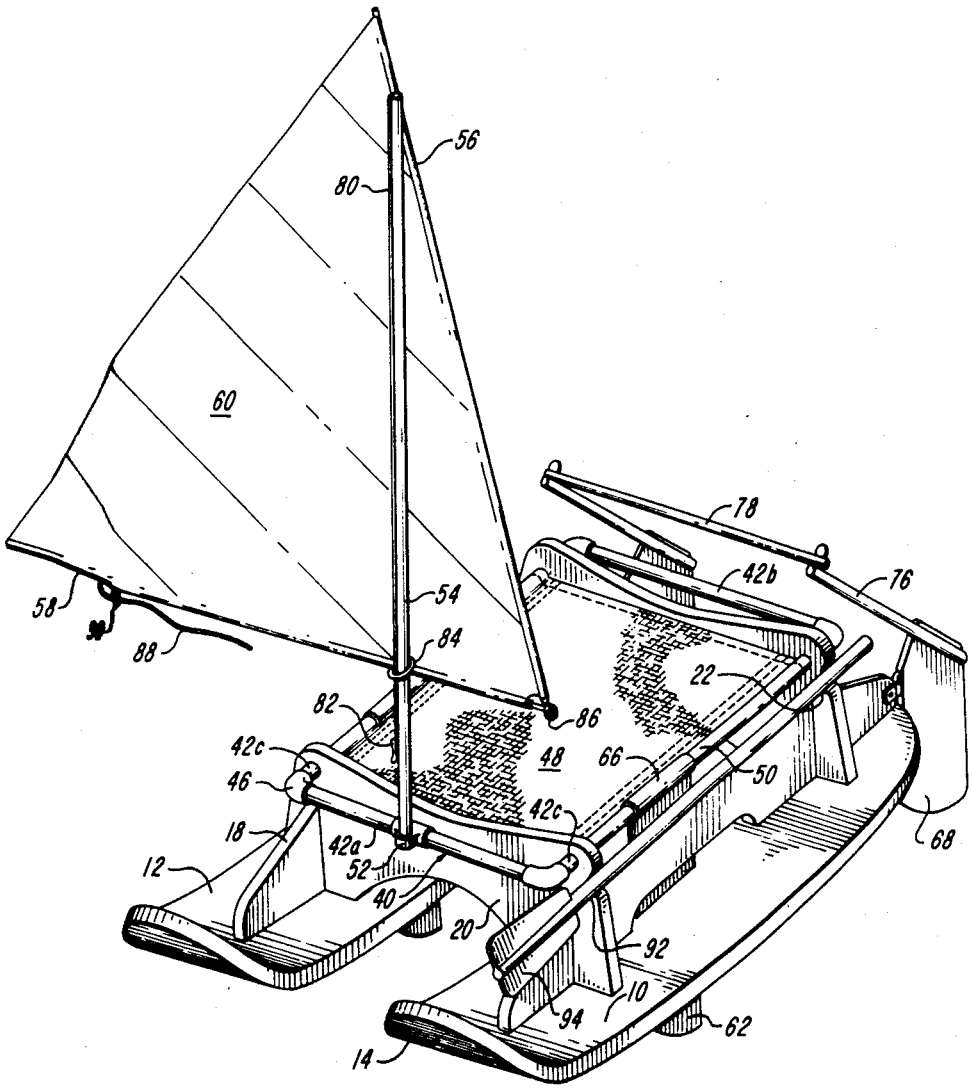
FIG. 1 is a pictorial view of the invention as embodied in a sailboat of catamaran type.

Referring to the drawings, there is shown a knock-down boat in accordance with the invention, which comprises first and second hulls 10 and 12, each of ski-like configuration having an upwardly curved forward end 14 and constructed of foam board or other lightweight buoyant material. First and second longitudinal members 16 and 18, each of identical foam board construction and configuration, are fitted to respective hulls 10 and 12 and are interconnected by a forward transverse member 20 and a rearward transverse member 22, each also of identical foam board construction and configuration. The longitudinal members 16 and 18 each include downwardly extending tabs or joints near the forward and rearward ends and which are cooperative with respective openings 26 in the associated hulls for joining each longitudinal member to the respective hull. Each tab or joint 24 in the illustrated embodiment is of split symmetrical configuration in which the halves 28 are resilient to be squeezed together for insertion through the associated opening 26 in the hull and, after full insertion, to spring apart such that the oppositely extending lip portions 30 lock to the underside of the hull. The forward transverse member 20 includes respective slotted openings 32 which are cooperative with the slotted confronting portions 34 of the longitudinal members 16 and 18 to interlock both longitudinal members to the forward transverse member, as illustrated. The ends of the transverse member 20 are sufficiently resilient to be pulled apart sufficiently to be fitted over the longitudinal members in order to engage the slotted portions of the longitudinal member within the opening of the transverse member. The rearward transverse member 22 has similar openings 36 which are cooperative with the confronting slotted ends 38 at the rear of the longitudinal members 16 and 18, and these components are similarly engaged as the forward transverse member and longitudinal members. Flanges 92 can be provided at one or both ends of the transverse members to secure one or two oars or paddles 94. Aligned openings can alternatively be provided in the transverse members for storage of one or more oars or paddles.

The hulls 10 and 12, longitudinal members 16 and 18 and transverse members 20 and 22, are each preferably die cut from the same foam board material. The foam board material is typically 4 pound polyethylene foam, about 2 inches thick, and may be of uniform composition or of laminated composition. The bottom layer of a laminated board can be of more highly abrasion resistant material than the core material to lessen wear in the event that the bottom hull surfaces engage rocks or a sandy floor. The board material can be colored for aesthetic appeal or may have one or more colored outer layers over a core of contrasting color. For greater buoyancy, the hulls can be of thicker and/or less dense material than the other constituents of the superstructure.

Figure 8:
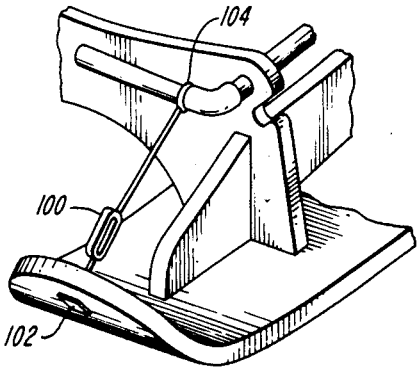
FIG. 8 is a cutaway pictorial view of an alternative means for providing the curved forward portion of the hulls.

The curved forward ends 14 of the hulls 10 and 12 can be formed by providing a series of parallel slices partially through the foam board and cementing the sliced portion in the curved position using a suitable adhesive such as a Neoprene resin modified rubber cement. The curved ends can alternatively be formed by a turnbuckle or other tension means which can be adjustable to produce the desired forward end configuration. As shown in FIG. 8, the turnbuckle 100 is secured at one end to the hull by a plate 102 on the underside of the hull, and at the other end by a hook 104 attached to the forward corner joint 46.

A pipe frame 40 is provided as shown and is composed of plastic, aluminum or other suitable pipe sections 42 which are retained within openings 44 near the corners of the transverse members 20 and 22. The forward and rearward pipe sections 42*a* and 42*b* are connected to elbow or corner joints 46 which are removably secured to the longitudinal pipe sections 42*c* for assembly and disassembly. A trampoline 48, formed of canvas or other suitable sheet material, is secured to the longitudinal pipe sections 42*c* by side sleeves 50 through which the longitudinal pipe sections are disposed, and lies within the area between the longitudinal pipe sections and transverse members, as illustrated. A fitting 52 is provided centrally of the forward transverse pipe section 42*a* to which a mast 54 can be connected. Spars 56 and 58 are connected to the mast for retention of a sail 60. If desirable, fasteners can be employed to secure the pipe sections. For example, locking pins can be inserted through aligned openings in the corner joints and pipe ends, or threaded set screws can be provided in the corner joints. Fasteners can also be provided in the mast fitting 52. The pipe sections can also be threadably attached to the corner joints.

A daggerboard 62 is fitted through a slot 64 in each hull and is secured at the upper end to the confronting longitudinal pipe section by a curved end 66 fitted over the pipe section and the covering sleeve of the trampoline. Alternatively, a portion of the sleeve 50 can be removed to allow attachment of the daggerboard end 66 directly onto the pipe section 42*c*. The daggerboard is preferably disposed to abut the inner side surface of the longitudinal member for improved lateral support. For some sailing applications, the daggerboards may not be needed, and are not usually needed for rowing or motor propulsion.

Figure 7:
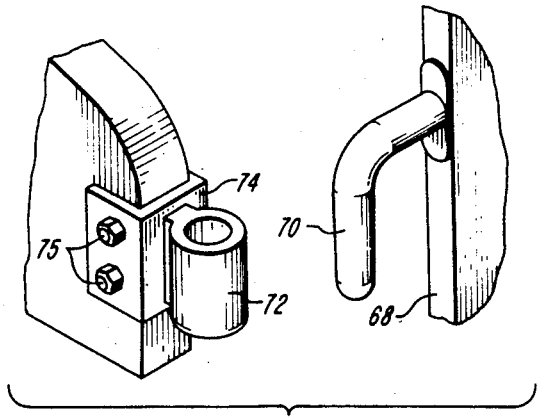
FIG. 7 is an exploded detail pictorial view of the pivotal coupling between the rudder and superstructure.

A pair of rudders 68 are provided outbound from each aft end of the respective hulls, and each is pivotally connected to the respective hulls by a convenient hinge or coupling such as a pintle 70 (FIG. 7) attached to rudder 68, and coupled to a gudgeon 72 attached to a bracket 74 which is affixed to the respective longitudinal members 16 and 18 by fasteners 75 extending through the bracket and member. Each rudder has affixed thereto a tiller 76, and the two tillers are interconnected by a cross-rod 78 for operation of the pair of rudders in unison. The rudder and daggerboard on each side are, in the illustrated embodiment, aligned on a common longitudinal axis and have the same shape at the below-water portion. The rudders and daggerboards are typically made of aluminum. The mast and spars are also typically of aluminum. The tillers and cross-rod are typically of wood or aluminum.

The spars and sail assembly are of lateen design in the illustrated version. The upper spar 56 is rotatably secured to the top of the mast by an uphaul line 80 which is secured to a cleat 82 near the bottom of the mast. Instead of a cleat 82, the line 80 can be secured to pipe section 42*a*. The lower spar 58 is rotably secured to the mast such as by a ring fitting 84, and the two spars are hinged such as by a ring fitting 86 at the confronting ends. The sail is fitted to the spars by any convenient means. For example, the spars can be fitted through pockets provided along the sail edges, or the sail can be attached to the spars by rings or other appropriate fittings. A main sheet 88 is rigged to the sail such as via a pulley 90 provided on the lower spar for sail adjustment in well-known fashion.

Figure 9:
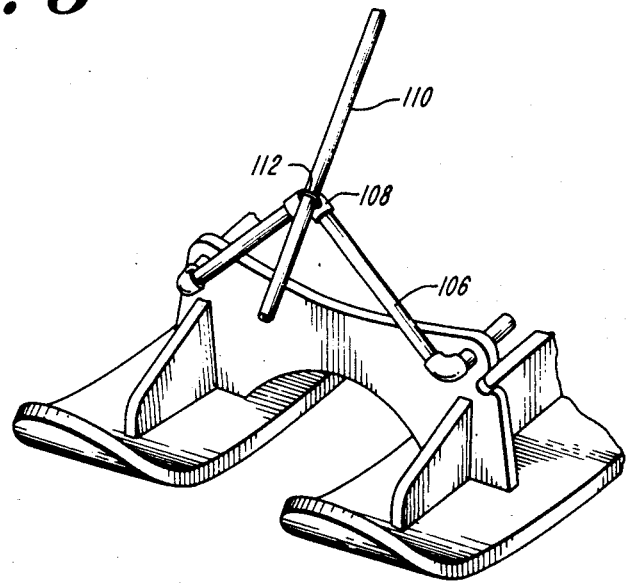
FIG. 9 is a cutaway pictorial view of an alternative frame for supporting a sail assembly.

An alternative frame structure is shown in FIG. 9, and includes front pipe sections 106 of inverted V-shape and joined by an elbow 108. A boom 110 is pivotably attached to elbow 108 such as with a ring fitting 112, and a loose footed sail 114 is secured to the boom by ring or other suitable fittings. Other sail configurations can also be employed for specific implementations.

Figure 10:
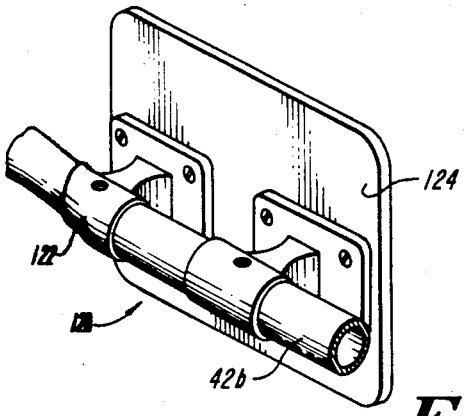
FIG. 10 is a cutaway pictorial view of a motor bracket useful in the invention.

The boat can be employed other than as a sailing craft. The boat can accommodate an outboard motor mounted on a bracket 120 attached to rear pipe section 42*b*, as shown in FIG. 10. The bracket includes rail supports 122 secured to pipe section 42*b*, and to which a plate 124, typically of marine plywood, is affixed. An outboard motor is attachable to the plate in usual fashion. The boat may also be paddled.

Figure 2:
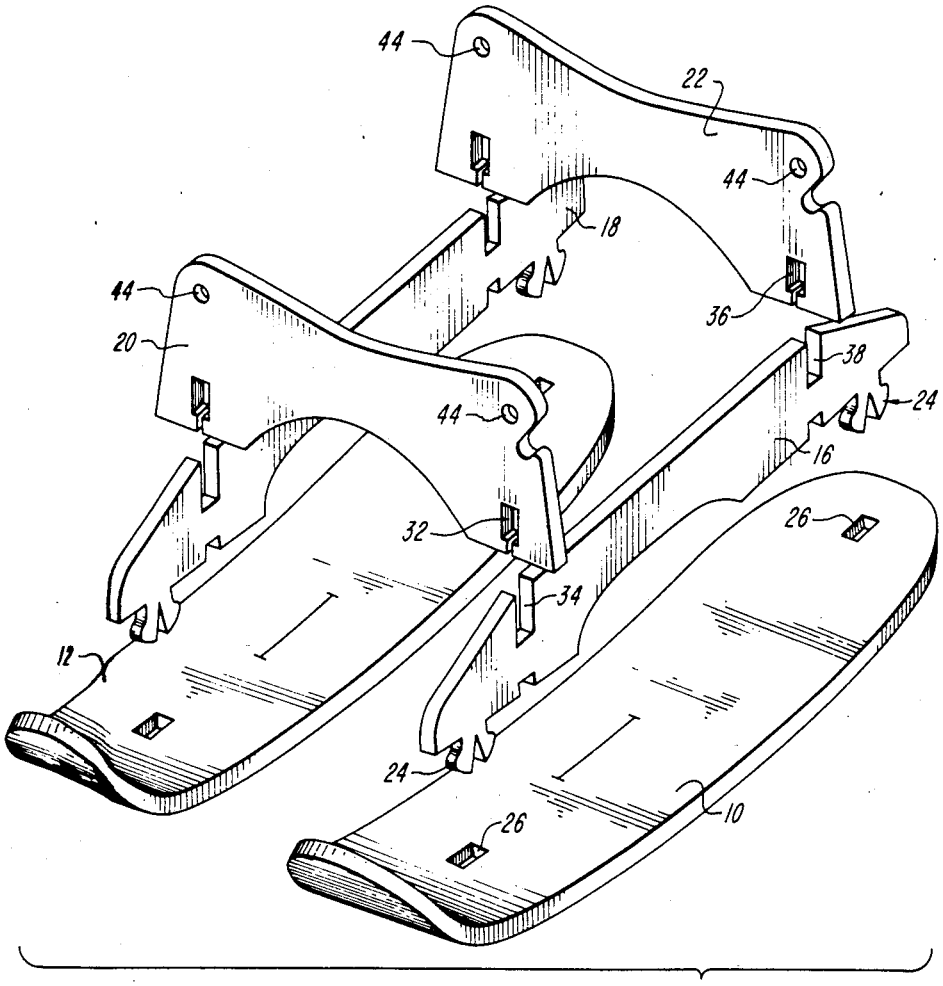
FIG. 2 is an exploded pictorial view of the superstructure of the embodiment of FIG. 1.
Figure 3:
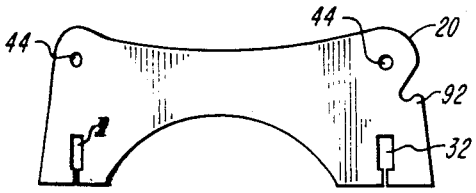
FIG. 3 is a plan view of the transverse member employed in the embodiment of FIGS. 1 and 2.
Figure 4:
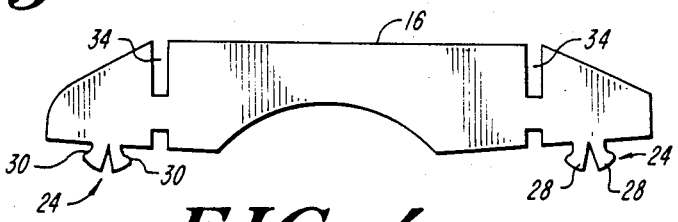
FIG. 4 is a plan view of the longitudinal member employed in the embodiment of FIGS. 1 and 2.
Figure 5:
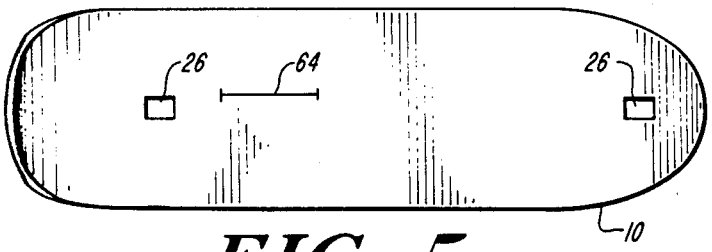
FIG. 5 is a plan view of the hull member employed in the embodiment of FIGS. 1 and 2.
Figure 6:
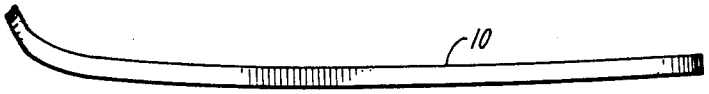
FIG. 6 is an elevation view of the hull member of FIG. 5.

For assembly of the boat, the longitudinal members 16 and 18 are each snapped into the openings of the associated hulls 10 and 12, and the transverse members 20 and 22 are respectively snapped onto the confronting portions of the longitudinal members to provide the superstructure of FIG. 2. The pipe frame 40 is then fitted to the trampoline and the transverse members, and the pipe sections 42 interconnected to complete the frame. The trampoline may remain attached to the pipe sections 42*c*, and these sections can be manipulated onto the transverse members during assembly. If employed, the rudders 68 are then fitted to the respective hulls by means of the pivotable connectors, and the daggerboards 62, if used, are inserted through the respective slots 64 in the respective hulls over respective pipe sections 42*c*. For sailing, the mast 54 is secured to the fitting 52, and the sail assembly then secured to the mast. Alternatively, the mast, spars and sail can remain as a unit and, after the mast is installed in the mast fitting, the sail can be unfurled.

For disassembly, the reverse procedure is employed. The sail is furled and the mast removed from its fitting, and the rudders and daggerboards are then removed. Thereafter, the pipe frame is disassembled and removed from the transverse members. The transverse members are then pulled out of locking engagement with the longitudinal members, and the longitudinal members are pulled out of locking engagement with the associated hulls. The foam parts of the superstructure can be readily bundled into a small package which can be carried in a canvas or other bag or otherwise tied or secured. The bag can also contain the other boat constituents, including the rudders, daggerboards, mast and sail assembly.

The boat can be constructed of any convenient size. In one present embodiment, the boat is about 7.5 feet in hull length, and the trampoline cockpit area is about 3 feet wide and 4 feet long. The hull members are each about 22 inches wide. The longitudinal members are about 6.5 feet long, and the transverse members are about 4.5 feet long. The trampoline is about 16 inches above the top surface of the hull members. The pipe frame is of 2 inch aluminum tubing, and the rudders and daggerboards are of 3/16 inch aluminum. The superstructure weighs about 10 pounds, and the pipe frame and mast weigh about 10 pounds. The boat is therefore extremely lightweight and can easily be carried by a person when disassembled. The boat can be conveniently boarded by stepping on one of the hull members with one foot and climbing onto the trampoline with the opposite leg. The boat can be of various sizes to suit the user's requirements. For relatively long sizes, the hull and longitudinal members can be hinged or jointed so that the disassembled length can be of convenient length for stowage and carriage.

The invention is not to be limited by what has been particularly shown and described, except as indicated in the appended claims.

What is claimed is:

1. A boat comprising:

a pair of hulls each of ski-like configuration, including:
- means for adjustably providing an upwardly curved forward end; and
- openings therethrough;

a pair of longitudinal members, including,
- means integral therewith for removable attachment of the longitudinal members to a respective one of the hulls; and
- a bearing surface which is adapted to confront and run longitudinally along the hull, the length of the bearing surface being greater than its width;
- the attachment means further including joint means integral therewith and cooperative with the openings in the associated hull to lock the longitudinal member to the hull, the joint means including an outwardly extending split symmetrical tab having oppositely extending lip portions and operative to be squeezed together for insertion through the associated opening in the hull and after insertion to spring apart into locking engagement; and
- slotted portions;

a pair of transverse members, including:
- associated transverse bearing surfaces which confront said hulls and run transverse to said longitudinal members, said transverse member bearing surfaces having a length greater than their width;
- means integral therewith for removable attachment of the transverse member to the longitudinal member to maintain the longitudinal members and connected hulls in speed relation;
- the attachment means further including slotted openings at the ends thereof and each cooperative with respective slotted portions of the longitudinal members for removable engagement therebetween;
- each of the hulls, longitudinal members and transverse members being of die cut foam board;
- support means removably attached to the transverse members for providing a cockpit area, said support means including:
  - a mast;
  - means for removably affixing the mast to the support means;
  - a sail assembly; and
  - means for adjustably attaching the sail assembly to the mast;
- a dagger board removably coupled to each of the hulls; and
- a rudder pivotably coupled to each of said longitudinal members.

2. The boat of claim 1 further including a bracket attached to the support means for mounting an outboard motor.

3. The boat of claim 1 wherein the support means include:
- a pipe frame composed of a plurality of pipe sections removably attached to the transverse members; and
- wherein a trampoline supported by the pipe sections between the transverse members provides the cockpit area.

4. The boat of claim 3 wherein the pipe frame further includes a pair of longitudinal pipe sections each attached to the transverse members, and forward and rearward pipe sections removably interconnecting the longitudinal pipe sections.

5. The boat of claim 1 wherein each of the hulls includes means for adjustably providing an upwardly curved forward end.

6. The boat of claim 1 wherein each of said hulls is of substantially identical configuration, each of said longitudinal members is of substantially identical configuration, and each of said transverse members is of substantially identical configuration.

* * * * *